106-83 AU 113 EX
7/31/79 XR 4,163,000

United States Patent [19]
Kashima et al.
[11] 4,163,000
[45] Jul. 31, 1979

[54] FOUNDRY MOLD COMPOSITION AND PROCESS FOR PRODUCING FOUNDRY MOLD

[75] Inventors: Jiro Kashima; Synji Sato, both of Urawa, Japan

[73] Assignee: Sekisui Kagaku Kogyo Kabushiki Kaisha, Osaka, Japan

[21] Appl. No.: 856,805

[22] Filed: Dec. 1, 1977

[30] Foreign Application Priority Data

| | | | |
|---|---|---|---|
| Dec. 3, 1976 | [JP] | Japan | 51-145809 |
| Apr. 6, 1977 | [JP] | Japan | 52-39752 |
| Apr. 6, 1977 | [JP] | Japan | 52-39753 |
| Jul. 22, 1977 | [JP] | Japan | 52-88490 |

[51] Int. Cl.[2] ..... C08L 25/04; B28B 7/34
[52] U.S. Cl. ..... 260/29.6 S; 106/38.3; 106/38.35; 106/83; 106/84; 164/43; 260/29.6 H; 260/42.11; 260/42.13
[58] Field of Search ..... 106/38.2, 38.35, 38.3, 106/83, 84; 260/42.11, 29.6 S, 42.13, 29.6 H; 164/43

[56] References Cited

U.S. PATENT DOCUMENTS

| | | | |
|---|---|---|---|
| 2,765,507 | 10/1956 | Wolf et al. | 260/42.11 |
| 2,817,128 | 12/1957 | Wickett | 106/38.3 |
| 2,853,461 | 9/1958 | Padbury et al. | 260/42.11 |
| 3,005,245 | 10/1961 | Howard | 164/43 |
| 3,104,230 | 9/1963 | Dewey et al. | 164/43 |
| 3,330,890 | 7/1967 | Holt et al. | 260/42.11 |
| 3,345,302 | 10/1967 | Netting et al. | 106/38.3 |
| 3,804,643 | 4/1974 | Arita et al. | 106/38.35 |

FOREIGN PATENT DOCUMENTS 2956 4/1955 Japan .

*Primary Examiner*—Lorenzo B. Hayes
*Attorney, Agent, or Firm*—Wenderoth, Lind & Ponack

[57] ABSTRACT

A foundry mold composition comprising a foundry mold sand, a binder in an amount sufficient to bind the sand and less than 1 part by weight, per 100 parts by weight of the sand, of clay, said binder being an aqueous solution of a water-soluble maleic acid-type copolymer in an amount of at least 1 part by weight per 100 parts by weight of the sand, and a process for producing a foundry mold, using aforesaid composition.

11 Claims, No Drawings

FOUNDRY MOLD COMPOSITION AND PROCESS FOR PRODUCING FOUNDRY MOLD

This invention relates to a foundry mold composition having various advantages including the freedom from environmental pollution by alkali which is usually associated with the discarding of foundry molds containing a water glass binder; and to a process for producing a foundry mold from this composition.

More specifically, the invention relates to a foundry mold composition comprising a foundry mold sand substantially free from clay, most commonly silica sand optionally containing less than 1% by weight of clay, per 100 parts by weight of the sand, of clay, and a binder in an amount sufficient to bind the sand, wherein the binder is an aqueous solution of a water-soluble maleic acid-type copolymer in an amount of at least 1 part by weight per 100 parts by weight of the sand.

It is well known to produce a foundry mold by mixing a foundry mold sand with an inorganic or organic binder, and forming the mixture into the desired shape of sand mold. With foundry molds containing water glass, the most widely used inorganic binder, it is difficult to remove water glass sufficiently from the used sand mold and to recover the sand for reuse. Hence, the used sand molds have been discarded. Water glass in the discarded molds gradually oozes out to cause environmental pollution. For example, it renders the soil alkaline to affect plants adversely. Or it adversely affects, or causes the death of, living organisms in the soil or in water.

Binders for sand mold production which can avoid such troubles have been desired, and suggested.

For example, Japanese Patent Publication No. 25527/67 published Dec. 6, 1967 discloses a process for producing a foundry mold which comprises mixing a foundry mold sand containing 1 to 30% by weight of calcium hydroxide with a partially saponified product of a polymer derived mainly from an acrylate or methacrylate ester, forming the mixture into the desired shape of mold, and hardening it. The mold produced by this method, however, does not possess feasible strength.

U.S. Pat. Nos. 2,343,972 and 3,024,215 and Japanese Patent Publication No. 17691/73 suggest the use of a self-curable organic binder using a furan or phenolic resin. According to this suggestion, the sand may be recovered for reuse by burning the organic material in the used sand mold. However, it has the defect that an offensive odor is given off at the time of burning, and that since the rate of curing the binder and the mechanical strength of the resulting mold vary considerably according to such factors as the nature of the sand, its water content, the temperature, the humdity, the type of the acid used as a curing agent, and the concentration of the acid, care is required in handling the binder. Furthermore, the prepolymer as a binder for phenolic resins and furan resins has poor storage stability, and gradually undergoes polymerization during storage. Hence, it is difficult to store the prepolymer for long periods of time.

The present inventors have worked on suitable binders which can afford foundry mold compositions free from the disadvantages of the prior art described hereinabove. The work led to the discovery that foundry mold compositions free from the aforesaid disadvantages can be provided by using a water-soluble maleic acid-type copolymer, for example a water-soluble copolymer derived from a maleic acid-type monomer selected from maleic acid, maleic anhydride and maleic acid esters and a comonomer copolymerizable therewith which is selected from vinyl monomers and olefin monomers, in an amount sufficient to bind and mold sand. It was also found that a better foundry mold composition can be obtained by using water glass together with the maleic acid-type copolymer, and that by further adding a powder of a silicon material selected from silicon-containing alloys, silicides and silicon to this composition, a foundry mold capable of being hardened by drying under self-generated heat can be provided. We also discovered that by utilizing the aforesaid compositions, foundry molds capable of being hardened with carbon dioxides can be provided.

The foundry mold composition and the process for producing foundry molds from the composition have various advantages among which are:

(a) The trouble of environmental pollution which is caused by alkali from discarded sand molds containing water glass can be avoided.

(b) Foundry molds can be easily produced from the composition of this invention.

(c) Adhesion of the sand to the surface of a casting prepared by using the mold is prevented. Even if the sand adheres, it can be easily removed.

(d) The sand can be easily and efficiently recovered from the used mold.

(e) The binder has good storage stability.

(f) After casting, the mold becomes brittle, and can be easily destroyed. Hence, the casting obtained can be easily taken out from the mold.

It is an object of this invention to provide an improved foundry mold composition.

Another object of this invention is to provide a process for producing an improved foundry mold.

The above and other objects and advantages of this invention will become more apparent from the following description.

According to this invention, there is provided a foundry mold composition comprising a foundry mold sand, a binder is an amount sufficient to bind the sand, and less than 1 part by weight, per 100 parts by weight of the sand, of clay, wherein the binder is an aqueous solution of a water-soluble maleic acid-type copolymer present in an amount of at least 1 part by weight per 100 parts by weight of the sand.

Utilization of a water-soluble polymer, which embraces the water-soluble maleic acid-type copolymers used in the invention, for the formation of foundry molds is disclosed, for example, in Japanese Patent Publication No. 2956/55 published on Apr. 30, 1955. This patent suggests a foundry mold composition having improved flowability which comprises a foundry mold sand, clay, water and a water-soluble polyelectrolyte derived from an aliphatic unsaturated compound and having a weight average molecular weight of at least 10,000 and a linear carbon chain. Examples of the polyelectrolyte illustrated are an ammonium salt of an isobutylene/maleic acid copolymer, a clacium salt of a styrene/maleic acid copolymer, and a calcium salt of a copolymer of vinyl acetate and a partially methyl-esterified maleic acid. In this patent, the purpose of using the maleic acid-type copolymer is to impart flowability or good processability in foundry mold production, and no disclosure or suggestion is made as to the intention of using it as a binder. This is substantiated by the fact that clay serving as a binder is used in the above composition. It is necessary to use 1.0 to 25 parts by weight, per 100 parts by weight of the foundry mold sand, of clay such as bentonite or refractory clay in this patent. The patent states that if the amount of the clay is less than 1.0 part by weight, the increasing of green sand strength and hardened sand strength is inhibited. The Patent also states that to obtain the best results, the amount of the copolymer should be adjusted to 0.02 to 0.1 part by weight per 100 parts by weight of the foundry mold sand, and within this limit, there are only slight effects of the copolymer on the green sand compressive strength and gas permeability, and the flowability of the composition is increased to greatly improve its processability in foundry mold production.

In the present invention, a foundry mold composition substantially free from clay is provided. If clay is incorporated in the composition in a substantial amount which is at least 1.0 part by weight and at most 25 parts by weight as is suggested in the above-cited patent, the maleic acid-type copolymer binder is absorbed by the clay and fails to perform the function of a binder for the foundry mold sand. Thus, if the maleic acid-type copolymer is to be used as a binder for the sand, it must be used in a larger amount to make up for the loss caused by its absorption by the clay. Even if a larger amount of the copolymer is used, a composition containing a substantial amount of clay causes a reduction in the strength of the foundry mold formed.

The incorporation of a substantial amount of clay should therefore be avoided in the present invention, and in any event, the amount of clay should be less than 1 part by weight, preferably not more than 0.5 part by weight, per 100 parts by weight of the mold sand.

No technical concept has heretofore been found which contemplates the use of the specified maleic acid-type copolymer in a substantially clay-free foundry mold composition as a binder the action of which is irrelevant to the increasing of the flowability of the composition during mold production. It has neither been known that the aforesaid advantages can be achieved by using the copolymer in an amount sufficient to bind the mold sand.

The aqueous solution of the water-soluble maleic acid-type-polymer used in an amount of at least 1 part by weight, preferably about 2 to about 10 parts by weight, per 100 parts by weight of the mold sand is, for example, a water-soluble copolymer drived from a maleic acid-type monomer selected from maleic acid, maleic anhydride and maleic acid esters and a comonomer selected from vinyl monomers and olefin monomers. Examples of the comonomer are styrene, vinyl acetate, acrylic acid, acrylate esters, metacrylic acid, methacrylate esters, vinyl chloride, ethylene, isobutylene, and propylene.

The method for producing such maleic acid-type copolymers is well known, and can be used in this invention, too. It can be prepared, for example, by reacting styrene and maleic anhydride in an organic solvent such as butyl acetate, benzene, xylene, cumene or acetone at a temperature of about 10° to about 90° C. in the presence of a polymerization catalyst such as cumene peroxide or benzoyl peroxide to form a styrene/maleic anhydride copolymer, then removing the solvent, contacting the copolymer with an inorganic alkali such as sodium hydroxide, potassium hydroxide, ammonia or an ammonium compound in an aqueous medium at a temperature of about 10° to about 90° C. to ring-open the maleic anhydride to form an alkali salt of the styrene/maleic acid copolymer.

The styrene/maleic acid copolymer may be partially esterified with a hydroxyl-containing compound such as methyl alcohol, ethyl alcohol, butyl alcohol, isobutyl alcohol, lauryl alcohol, β-hydroxyethyl methacrylate, or β-hydroxypropyl acrylate. The partial esterification can be performed, for example, by adding the hydroxyl-containing compound to an aqueous solution of the copolymer, and heating the mixture to about 50° C. to about 80° C. Or the alkali salt of the styrene/maleic acid copolymer can be prepared by dissolving the styrene/maleic acid copolymer in a solvent such as acetone, adding the hyroxyl-containing compound and an acid catalyst, reacting the copolymer with the hydroxyl-containing compound, and contacting the resulting partial ester with the inorganic alkali in an aqueous medium at a temperature of about 10° to about 90° C.

The water-soluble copolymer derived from the maleic acid-type monomer and any other vinyl monomer can be produced in the same way as above except that the vinyl monomer is used instead of the styrene. When the other vinyl monomer is gaseous, the reaction is carried out under elevated pressures.

The water-soluble copolymer derived from the olefin monomer and the maleic acid-type monomer can be produced under elevated pressure in the same way as above except that the olefin monomer is used instead of styrene.

The ratio of the maleic acid-type monomer to the vinyl monomer and/or olefin monomer copolymerizable therewith can be varied, and is, for example, 1:1 to 1:3, preferably 1:1 to 1:2.

If desired, the composition of this invention may also contain water glass with the formula $Na_2O.nSiO_2$ wherein n is 2 to 3 in addition to the water-soluble maleic acid-type copolymer. In the embodiment of using water glass, it is not necessary to render the maleic acid-type copolymer water-soluble in advance, because the maleic acid-type copolymer becomes water-soluble as a result of reaction with an alkaline ingredient in the water glass at the time of mixing.

The composition of this invention may contain a thickener or a dissolving assistant (for increasing compatibility with water glass). Examples of the thickener are water-soluble polymeric materials such as soluble starch, gelatin, carboxymethyl cellulose, hydroxyethyl cellulose, dextrin, polyvinyl alcohol and polyethylene glycol. Examples of the dissolving assistant are water-soluble carbohydrates such as sucrose, glucose, dextrin, fructose, and sorbitol. Of these, sucrose, glucose and sorbitol are preferred.

In the composition of this invention, the water-soluble maleic acid-type copolymer is used in the form of an aqueous solution, and its amount is at least 1 part by weight, preferably about 2 to about 10 parts by weight, more preferably about 2 to about 7 parts by weight, per 100 parts by weight of the foundry mold sand. Preferably, the aqueous solution of the water-soluble maleic acid-type copolymer has a viscosity of not more than about 30,000 centipoises. When water glass is not used conjointly, the preferred viscosity of the aqueous solution is about 1,000 to about 30,000 centipoises, and when water glass is used conjointly, the viscosity of the aqueous solution of the copolymer may be lower, for example, about 500 to about 10,000 centipoises. When the thickener or dissolving agent is incorporated, the viscosity of the composition containing such additives should preferably be within the above-specified range.

A mixture of the above copolymer and water glass may be used as the binder. In this embodiment, the viscosity of the binder decreases markedly by the mixing of water glass. The suitable viscosity of such binder mixture is, for example, about 5 to about 3000 centipoises.

If the viscosity of the binder exceeds about 30,000 centipoises, uniform mixing with the foundry mold sand is difficult.

When water glass is not used together, the amount of the maleic acid-type copolymer (as solids excluding water) is preferably about 0.05 to about 2 parts by weight, more preferably about 0.1 to about 1 part by weight, per 100 parts by weight of the mold sand. If the amount is too small, the dry strength of the foundry mold obtained is unsatisfactory. The use of too large amounts does not give rise to a further improvement, and is uneconomical.

When the water-soluble maleic acid-type copolymer and water glass are used conjointly, the total amount of them in the form of an aqueous solution is at least 1 part by weight, preferably about 2 to about 10 parts by weight, more preferably about 2 to about 7 parts by weight, per 100 parts by weight of the sand. At this time, it is preferred to adjust the total solids content of the copolymer and water glass to about 20 to about 60% by weight, especially about 30 to about 50% by weight, based on the weight of the liquid mixture of the two. Conveniently, the weight ratio of the copolymer solid to the water glass solid is 1:0.5–10.

When water glass is used conjointly, the resulting foundry mold composition can be formed into a foundry mold which can be cured with $CO_2$ or by drying under self-generated heat. If the ratio of the water glass to the copolymer increases beyond 10:1, there is a tendency that the advantages of utilizing the specific copolymer, such as the ease of disintegration of the mold after use and the re-usability of the mold sand are reduced. Hence, the water glass is preferably used in a ratio within the above-specified range.

According to one embodiment of the present invention, there can be provided a foundry mold composition comprising a foundry mold sand, a binder in an amount sufficient to bind and sand and less than 1 part by weight, per 100 parts by weight, of clay, said binder being an aqueous solution of an inorganic alkali salt of a styrene/maleic acid copolymer with a viscosity of about 1,000 to about 30,000 centipoises, preferably about 3,000 to about 5,000 centipoises, the amount of the binder being at least 1 part by weight, preferably about 2 to about 10 parts by weight, more preferably about 2 to about 7 parts by weight, per 100 parts by weight of the sand.

For example, a 10% aqueous solution of a sodium salt of a styrene/maleic acid copolymer having a molecular weight of 4,500, an acid value of 190 and a melting point of 110° C. has a viscosity of about 10 centipoises at 20° C., and a 10% aqueous solution of an ammonium salt of the above styrene/maleic acid copolymer has a viscosity of about 3,000 centipoises.

The viscosities of the binder solutions, as referred to in this application, are those measured at 20° C.

A foundry mold can be produced by forming the composition into a former of the desired shape, removing the former, and drying the formed product. Drying can be performed by any known methods such as the use of a drying oven, the blowing of hot air, the use of a high frequency induction heater, or spontaneous drying by standing after mold production. The drying can be performed at room temperature to about 200° C.

According to another embodiment of the invention, there is provided a foundry mold composition comprising a foundary mold sand, a binder in an amount sufficient to bind the sand and less than 1 part by weight per 100 parts by weight of the sand, of clay, said binder being an aqueous solution of a water-soluble copolymer derived from a maleic acid-type monomer selected from the group consisting of maleic acid, maleic anhydride and maleic acid esters and a comonomer selected from the group consisting of vinyl acetate, acrylic acid, acrylate esters, methacrylic acid, methacrylate esters, vinyl chloride, ethylene, isobutylene and propylene and having a viscosity of about 1,000 to 30,000 centipoises, preferably about 3,000 to about 5,000 centipoises, the amount of said binder being at least 1 part by weight, preferably about 2 to about 10 parts by weight, more preferably about 2 to about 7 parts by weight, per 100 parts by weight of the mold sand. The composition according to this embodiment can also be formed into a foundry mold of the desired shape in the same way as described hereinabove.

Thus, according to the present invention, there is provided a process for producing a foundry mold, which comprises mixing 100 parts by weight of a foundry mold sand containing less than 1 part by weight of clay with about 2 to about 10 parts by weight, of an aqueous solution of a water-soluble maleic acid-type copolymer having a viscosity of about 1,000 to about 30,000, forming the mixture into a mold, and drying it.

According to still another embodiment of the present invention, there is provided a foundry mold composition comprising a foundry mold sand, a binder in an amount sufficient to bind the sand and less than 1 part by weight, per 100 parts by weight, of clay, said binder consisting of water glass and an aqueous solution of a water-soluble maleic acid-type copolymer in a total amount of at least 1 part by weight, preferably about 2 to about 10 parts by weight, per 100 parts by weight of the sand, and the aqueous solution of the copolymer preferably having a viscosity of about 500 to about 10,000 centipoises. The preferred ratio between the copolymer and water glass and their solids contents are the same as those described hereinabove. The use of the dissolving assistant in this embodiment frequently gives satisfactory results in facilitating the uniform mixing of the two binder ingredients.

When water glass containing solids and water in a ratio of approximately 1:1, it is advisable to use 50 to 700 parts by weight of water and 50 to 500 parts by weight of the maleic acid-type copolymer per 100 parts by weight of the solids of water glass. Preferably, 100 to 400 parts by weight of water and 70 to 300 parts by weight of the maleic acid-type copolymer are used per 100 parts by weight of the solids of water glass.

The composition according to this embodiment is of a $CO_2$ hardening type. A foundry mold can be produced by forming the composition in a former of the desired shape, contacting the formed article with carbon dioxide gas by blowing or other means to harden the binder, removing the former from the mold hardened by carbon dioxide gas, and optionally drying the mold. Drying can be performed by any desired means such as those exemplified hereabove.

Thus, according to this invention, there is provided a process for producing a foundry mold, which comprises mixing 100 parts of a foundry mold sand containing less than 1 part by weight of clay with about 2 to about 10 parts by weight in total of an aqueous solution of a water-soluble maleic acid-type copolymer having a viscosity of about 500 to about 10,000 and water glass, forming the mixture into a mold, and contacting the mold with carbon dioxide gas.

According to yet another object of this invention, there is provided a foundry mold composition comprising a foundry mold sand, a binder in an amount sufficient to bind the sand and less than 1 part by weight, per 100 parts by weight, of clay, said binder consisting of, per 100 parts by weight of the mold sand, about 2 to about 10 parts by weight in total of water glass and an aqueous solution of a water-soluble maleic acid-type copolymer and about 1 to about 6 parts by weight of a powder of a silicon material selected from silicon-containing alloys, silicides and silicon. Preferably, the viscosity of the aqueous solution of the copolymer is about 500 to about 10,000. When the copolymer and water glass are used in a pre-mixed state, the viscosity of the mixture is preferably about 5 to about 3,000. The composition according to this embodiment is of the type which dries under self-generated heat. The alkali ingredient in water glass optionally with an additional amount of alkali such as an alkali hydroxide, water and the powder of a silicon material react exothermically, and the reaction mixture self-hardens while evolving hydrogen (the so-called "N-process"), thereby to form a foundry mold of the desired shape.

Thus, according to the invention, there is provided a process for producing a foundry mold, which comprises mixing 100 parts by weight of a foundry mold sand containing less than 1 part by weight of clay with about 2 to about 10 parts in total of water glass and an aqueous solution of a water-soluble maleic acid-type copolymer having a viscosity of about 500 to about 10,000, and about 1 to about 6 parts by weight of a powder of a silicon material selected from the group consisting of silicon-containing alloys, silicides and silicon, forming the mixture into a mold, and drying the mold under self-generated heat.

In the embodiments described hereinabove, silica sand is most commonly used as the foundry mold sand, and includes, for example, river sand, sea shore sand, and sand resulting from crushing rocks. The suitable particle size of the sand is from 10 mesh (Tyler mesh) under to 200 mesh on. As already stated, the composition of this invention does not contain a substantial amount of a clay such as bentonite. Even when the mold sand contains clay inevitably, its amount should be less than 1 part by weight, preferably less than 0.5 part by weight, per 100 parts by weight, of the sand.

The silicon material used in the last-mentioned embodiment includes silicon-containing alloys such as ferrosilicon, silicides such as calcium silicide and magnesium silicide, and silicon powder. Preferably, the silicon material has a particle size of 50 mesh under (Tyler mesh).

According to the invention, castings can be produced by placing various molten metal materials, for example, copper or copper alloys such as bronze and brass, aluminum or aluminum alloys, iron or iron alloys such as steel or stainless steel, in the molds prepared in the manner described hereinabove, cooling the castings, and destroying the molds in a customary manner.

Since the binder used in the composition of this invention is the water-soluble maleic acid-type copolymer or a binder containing the copolymer, adhesion of the mold sand to the surface of the casting can substantially be prevented. Even if the sand adheres, it can be easily removed. Moreover, dust does not occur during the mixing of the binder with the sand. Another advantage is that the sand used needs not to be dried fully, and somewhat wet sand may be used.

The mold used in the production of castings can be destroyed also by merely dipping it in water, unlike the case of sand molds containing only water glass as a binder. The sand particles or small agglomerates of sand after mold destruction can be easily regenerated for use by such means as washing with water, sand blasting, sand milling, or burning. Of course, other conventional destroying methods such as impact by a hammer can also be used to destroy the used sand mold.

The binder used in this invention has good storage stability, and is fully usable and stable even after storage for several years. It is very easy to handle and has good processability in mold formation, because it is scarcely affected by temperatures and humidities during use or the type of the sand used. The binder used in the invention is also advantageous since it does not give off noxious gases such as $SO_x$, $NO_x$ and HCl when the sand is regenerated by burning.

The following examples illustrate the present invention more specifically.

EXAMPLE 1

Sand (100 parts by weight) was kneaded with 5 parts by weight of an aqueous solution of a sodium salt of a styrene/maleic acid copolymer (concentration 25%; viscosity 2,000 cps) for 5 minutes by a Simpson-type sand mill. The mixture was taken out, and formed into a main mold and dried with hot air at 180° C. for 30 minutes to form a main mold. The compressive strength of the main mold was found to be 30 kg/cm$^2$.

One kg of a mold formed in a core form from the above mixture was dried for 30 seconds in a 5 kw high frequency dryer to form a core having a compressive strength of 43 kg/cm$^2$. A mold was produced from the main mold and the core. Cast iron molten at 1350° C. was poured into the mold. A casting having a smooth surface was thus produced.

COMPARATIVE EXAMPLE 1

Sand (100 parts by weight), 3 parts by weight of linseed oil (a conventional binder) and 0.5 part by weight of a curing catalyst were kneaded in a Simpson-type sand mill. The mixture was molded in a main mold form, and dried with hot air at 180° C. for 30 minutes. The resulting main mold had a compressive strength of 1 kg/cm$^2$ and could not be used as a mold. When the main mold was further dried for 30 minutes, its compressive strength increased to 5 kg/cm$^2$, but was still insufficient for a mold. When it was dried for another 1 hour, a main mold having a compressive strength of 30 kg/cm$^2$ was obtained.

The above mixture obtained in the Simpson-type sand mill was formed into a core, and dried for 30 seconds in a 5 KW high frequency dryer. The resulting core had a compressive strength of less than 1 kg/cm$^2$. It was then further dried with hot air at 180° C. for 2 hours to form a core having a compressive strength of 30 kg/cm$^2$.

EXAMPLE 2

Carboxymethyl cellulose (2 parts by weight) was added to an 18% aqueous solution of a sodium salt of a styrene/maleic acid copolymer having a molecular weight of 4,000 and an acid value of 170. They were well stirred to dissolve the sodium salt completely and to form an aqueous binder solution having a viscosity of 4,800 centipoises at 20° C.

To 100 parts by weight of silica sand was added 4 parts by weight of the aqueous binder solution, and they were sufficiently mixed so that the binder adhered uniformly to the surface of the silica sand. The resulting mixture was poured into a former and compressed. After compression, the mixture was allowed to stand for a while so that it would not disintegrate upon removing the former. Then, the former was removed to form a mold. The compressive strength (the method for testing the strength of foundry sand according to JIS-Z 2604) of the mold immediately after removal of the former was 100 g/cm$^2$.

The mold was dried in a high frequency heater to form a dried mold which was found to have a compressive strength of 10 kg/cm$^2$.

Molten pig iron at 1,300° C. was poured into the dried mold so obtained, and then cooled. When the mold was dipped in water after cooling, it readily disintegrated to give a casting having a smooth surface. During this operation, scarcely any dust occurred. The silica sand in the water could be re-used after washing with water.

EXAMPLE 3

To 100 parts by weight of water was added 15 parts by weight of an ammonium salt of a styrene/maleic acid copolymer having a molecular weight of 4,500 and an acid value of 190. They were well stirred to dissolve the polymer salt completely and to form an aqueous binder solution having a viscosity at 20° C. of 10,000 centipoises.

To 100 parts by weight of silica sand was added 3 parts by weight of the aqueous binder solution, and a mold was produced in the same way as in Example 2. The mold had a compressive strength of 110 g/cm$^2$ before drying, and 15 kg/cm$^2$ after drying.

Molten pig iron at 1300° C. was poured into the resulting mold and cooled. The mold was disintegrated to form a casting having a smooth surface.

The silica sand disintegrated could be re-used after burning in a burning furnace.

EXAMPLE 4

To 100 parts by weight of water were added 20 parts by weight of a sodium salt of a styrene/maleic acid copolymer (molecular weight 6,000; acid value 150) and 10 parts by weight of soluble starch. They were stirred well to dissolve these material completely in water and to form an aqueous binder solution having a viscosity of 20,000 centipoises.

To 100 parts by weight of silica sand was added 2.5 parts by weight of the aqueous binder solution, and a mold was produced in the same way as in Example 2.

The mold had a compressive strength of 150 g/cm$^2$ before drying and 13.2 kg/cm$^2$ after drying.

Molten pig iron at 1300° C. was poured into the resulting mold, and a casting having a smooth surface was obtained in the same way as in Example 2. There was scarcely any dust formation during this operation, and the silica sand in the water could be re-used after washing with water.

EXAMPLE 5

Sand (100 parts by weight), 1 part by weight of an aqueous solution of a sodium salt of a styrene/maleic acid copolymer (concentration 30%; viscosity 5,000 centipoises) and 3 parts by weight of water glass (2.3 M 48% aqueous solution) were kneaded in a Simpson-type sand mill for 5 minutes. The mixture was formed into a mold, and carbon dioxide gas was blown into it at a pressure of 1 kg/cm$^2$ for 1 minute to cure it. The mold obtained had a compressive strength of 15 kg/cm$^2$.

Cast iron at 1350° C. was poured into this mold to form a casting, and cooled. The mold was disintegrated, and the casting could be easily taken out from it. Some amount of sand adhering to the surface of the casting could be removed easily.

In order to examine disintegrability, the mold cured with carbon dioxide gas was heated to 700° C. for 10 minutes, and cooled. The compressive strength of the resulting mold was as small as 2 kg/cm$^2$.

COMPARATIVE EXAMPLE 2

Sand (100 parts by weight) and 5 parts by weight of water glass (2.3 moles, 48%) were kneaded for 3 minutes in a Simpson-type sand mill, and the mixture was formed into a mold which was then cured by blowing carbon dioxide gas under a pressure of 1 kg/cm$^2$ for 1 minute. The resulting mold had a compressive strength of 20 kg/cm$^2$.

Cast iron at 1350° C. was poured into the mold to form a casting. After cooling, the mold was disintegrated, and an attempt was made to withdraw the casting. But it was difficult to withdraw the casting, and therefore the mold was destroyed by a hammer to take out the casting. Since the sand adhered tightly to the surface of the casting taken out, it was removed by using a hammer.

To evaluate disintegrability, the mold cured with carbon dioxide was heated to 700° C. for 10 minutes and then cooled. The mold was found to have a compressive strength of 25 kg/cm$^2$.

COMPARATIVE EXAMPLE 3

Sand (100 parts by weight), 1.5 parts by weight of a 20% aqueous solution of sugar and 5 parts by weight of water glass (2.3 moles, 48% aqueous solution) were kneaded for 5 minutes in a Simpson-type sand mill. The mixture was formed into a mold and then cured by blowing carbon dioxide gas under a pressure of 1 kg/cm$^2$ for 1 minute. The resulting mold had a compressive strength of 15 kg/cm$^2$.

Cast iron at 1350° C. was poured into the mold to form a casting.

After cooling, the mold was destroyed, and an attempt was made to take out the casting from it, but in vain. Hence, the mold was destroyed by striking it with a hammer, and the casting was taken out. The sand adhering to the surface of the casting was removed by using a spatula.

To evaluate disintegrability, the mold cured with carbon dioxide gas was heated at 700° C. for 10 minutes, and cooled. The compressive strength of the cured mold was 7 kg/cm$^2$.

EXAMPLE 6

Sand (100 parts by weight) was well mixed with 3 parts by weight of a 40% by weight aqueous solution (viscosity 5,000 centipoises) of a sodium salt of a styrene/maleic acid copolymer and 1 part by weight of water glass (2.5 moles of $SiO_2$; the weight ratio of solids to water being approximately 1:1). The mixture was placed in a former, and pounded. Carbon dioxide gas was then blown into the former, and then the former was removed to form a mold.

Immediately after removing the former, the mold had a compressive strength of 100 g/cm$^2$.

The mold was dried in a high frequency heater. The dried mold had a compressive strength of 24 kg/cm$^2$.

Molten pig iron at 1300° C. was poured into the resulting mold, and cooled. When the mold was then dipped in water, it was readily disintegrated to afford a casting having a smooth surface.

During this operation, there was scarcely any dust formation. The silica sand in the water could be re-used after washing with water.

EXAMPLE 7

Sand (100 parts by weight) was mixed well with 2 parts by weight of a 40% by weight aqueous solution (viscosity 5,000 centipoises) of a sodium salt of a styrene/maleic acid copolymer and 2 parts by weight of water glass (2.3 moles of $SiO_2$; the weight ratio of solids to water being approximately 1:1). The mixture was placed in a former, and compressed. Then, carbon dioxide gas was blown into it, and the former was removed. Immediately after removing the former, the mold had a compressive strength of 4 kg/cm$^2$.

When the mold was dried by a hot air dryer, its compressive strength was 20 kg/cm$^2$.

Molten pig iron at 1300° C. was poured into the resulting mold, and cooled. The mold was destroyed by a hammer to afford a casting having a smooth surface. Adhesion of sand to the surface of the casting was very little, and the adhering matter could be easily removed by touching it with fingers. The disintegrated sand could be regenerated by a rubbing regenerating machine.

EXAMPLE 8

Sand (100 parts by weight) was well mixed with 1 part by weight of a 40% by weight aqueous solution (viscosity 5,000 centipoises) of a sodium salt of a styrene/maleic acid copolymer and 3 parts by weight of water glass (the same as that used in Example 6). The mixture was poured into a former, and compressed. Carbon dioxide gas was blown into the mixture, and then the former was removed. Immediately after removing the former, the resulting mold was found to have a compression strength of 9 kg/cm$^2$.

The mold was dried by an infrared dryer. The dried mold was found to have a compressive strength of 30 kg/cm$^2$.

Molten pig iron at 1300° C. was poured into the resulting mold, and cooled. Then, the mold was destroyed by a hammer to afford a casting having a smooth surface. Adhesion of the sand to the surface of the casting was very little, and could be easily removed by touching it with fingers.

EXAMPLE 9

Sand (100 parts by weight) was fully mixed with 2 parts by weight of a 35% aqueous solution (viscosity 4,000 centipoises) of a sodium salt of a vinyl acetate/maleic anhydride copolymer and 2 parts by weight of water glass (the same as that used in Example 7). The resulting mixture was poured into a former, and compressed. Carbon dioxide gas was blown into it, and the former was removed to produce a mold. Immediately after removing the former, the mold had a compressive strength of 5 kg/cm$^2$. When the mold was dried by a hot air dryer, its compressive strength increased to 23 kg/cm$^2$.

Molten pig iron at 1300° C. was poured into the mold obtained by the above procedure, and then cooled. After cooling, the mold was destroyed by a hammer to afford a casting having a smooth surface.

EXAMPLE 10

A solution of 5 parts by weight of sucrose in 20 parts by weight of water was added to 20 parts by weight of water glass (2.3 moles of $SiO_2$; the weight ratio of solids to water being approximately 1:1). They were stirred well to form a uniform solution. To the solution was added gradually 40 parts by weight of a 40% by weight aqueous solution (viscosity 5,000 centipoises) of a sodium salt of a styrene/maleic acid copolymer. The mixture was well stirred, whereupon bubbles formed and a solution of uniform composition resulted. Thus, a binder for foundry sand was formed. Four parts by weight of the foundry sand binder was well mixed with 100 parts by weight of silica sand. The resulting mixture was poured into a former, and compressed. Then, carbon dioxide gas was blown into the mixture, and the former was removed to produce a mold. After removing the former, the mold was found to have a compressive strength of 3.2 kg/cm$^2$.

The mold was dried in a high frequency induction heater. The dried mold had a compressive strength of 35 kg/cm$^2$.

Molten pig iron at 1300° C. was poured into the mold, and cooled.

When the mold was dipped in water after cooling, it readily disintegrated to afford a casting having a smooth surface.

During this operation, there was scarcely any formation of dust, and the sand after disintegration could be re-used after washing with water.

EXAMPLE 11

Water (20 parts by weight) was added to 20 parts by weight of water glass (2.5 moles of $SiO_2$; the weight ratio of solids to water being approximately 1:1). The mixture was well stirred to form a uniform solution. Then, 60 parts by weight of a 30% aqueous solution of a sodium salt of an isobutylene/maleic acid copolymer was added gradually, and the mixture was well stirred. Bubbles formed, and the copolymer dissolved to form a foundry sand binder.

Silica sand (100 parts by weight) was well mixed with 5 parts by weight of the foundry sand binder. The resulting mixture was placed in a former, and compressed. Then, carbon dioxide gas was blown into the mixture, and the former was removed. The mold obtained had a compressive strength of 2.5 kg/cm$^2$.

When the mold was dried by a hot air dryer, its compressive strength increased to 25 kg/cm$^2$.

Molten pig iron at 1300° C. was poured into the mold, and cooled. After cooling, the mold was destroyed by a hammer to afford a casting having a smooth surface.

Adhesion of sand to the surface of the casting was very little, and the adhering matter could be easily removed by merely touching it with fingers. When the disintegrated sand was burned, the binder adhering to its surface charred. It was then removed by a sieve. The binder easily separated from the sand, and the sand could be re-used.

EXAMPLE 12

A solution of 5 parts by weight of sorbitol in 45 parts by weight of water was added to 20 parts by weight of water glass (2.0 moles of $SiO_2$; the weight ratio of solids to water being approximately 1:1). The mixture was well stirred to form a uniform solution. The solution ion was warmed to 80° C., and with stirring, 15 parts by weight of a styrene/maleic anhydride copolymer was gradually added. With the generation of bubbles, the copolymer dissolved. Thus, a foundry sand binder was obtained. Silica sand (100 parts by weight) was well mixed with 4 parts by weight of the resulting foundry sand. The mixture was placed in a former, and compressed. Then, carbon dioxide gas was blown into the mixture, and then the former was removed to form a green mold. The green mold had a compressive strength of 3.5 kg/cm$^2$.

When the green mold was dried by an infrared dryer, its compressive strength increased to 38 kg/cm$^2$.

Molten pig iron at 1300° C. was poured into the dried mold, and cooled. After cooling, the mold was destroyed by a hammer. It distintegrated easily to afford a casting having a smooth surface.

Adhesion of the sand to the surface of the casting was very little, and the adhering matter could be removed easily by merely touching it with fingers.

The disintegrated sand was regenerated in a regenerator machine based on rubbing. The sand could be very simply regenerated for re-use.

EXAMPLE 13

Silica sand (100 parts by weight) was mixed with 2 parts by weight of ferrosilicon powder, and then 5 parts by weight of water glass (solids content about 50%) and 3 parts by weight of a 40% aqueous solution of a sodium salt of a styrene/maleic acid copolymer were added. They were all mixed and formed into a mold. The flowability of sand at the time of mold formation was very good. The mold had a compressive strength of 15 kg/cm$^2$ after a lapse of 2 hours from formation, 20 kg/cm$^2$ after 4 hours, and 40 kg/cm$^2$ after 24 hours.

Molten pig iron at 1350° C. was poured into this mold, and cooled to afford a good quality casting. The disintegrability of the mold sand at this time was very good, and there was hardly any adhesion of sand to the surface of the casting. The sand adhering to the surface of the casting in a small amount could be easily removed. The sand could be easily regenerated in a regenerator device based on rubbing.

EXAMPLE 14

Forty parts by weight of a 45% aqueous solution of a sodium salt of a vinyl acetate/maleic anhydride copolymer, 10 parts by weight of glucose, 40 parts by weight of water glass (solids content about 50%), and 10 parts by weight of water were uniformly mixed.

Six parts by weight of the resulting mixture was well mixed with a mixture of 100 parts by weight of silica sand and 1.5 parts by weight of ferrosilicon powder. The mixture was then formed into a mold. The flowability of the sand at the time of mold formation was very good.

The resulting mold had a compressive strength of 10 kg/cm$^2$ after a lapse of 2 hours, 15 kg/cm$^2$ after 4 hours, and 30 kg/cm$^2$ after 24 hours.

Aluminum alloy at 700° C. was poured into the resulting mold to form a casting having a smooth surface.

The sand had very good disintegrability. The sand was burned in a fluidized burning furnace, and good quality sand could be recovered.

EXAMPLE 15

Forty parts by weight of a 40% aqueous solution of a sodium salt of a styrene/maleic acid copolymer, 5 parts by weight of sugar, 30 parts by weight of water glass (solids content about 50%) and 25 parts of water were uniformly mixed.

Three parts by weight of the mixture obtained was well mixed with an intimate mixture of 100 parts by weight of silica sand and 2 parts by weight of ferrosilicon powder. Further, 2 parts by weight of water glass was added, and they were well mixed. The resulting mixture was formed into a mold. The flowability of sand during mold formation was very good. The mold had a compressive strength of 13 kg/cm$^2$ after a lapse of 2 hours from mold formation, 20 kg/cm$^2$ after 4 hours, and 35 kg/cm$^2$ after 24 hours.

Pig iron at 1300° C. was poured into the resulting mold, and cooled to produce a casting having a smooth surface. The disintegrability of the sand was very good.

What we claim is:

1. A foundry mold composition which comprises a foundry mold sand, a binder in an amount of at least 1 part by weight per 100 parts by weight of the sand and sufficient to bind the sand and less than 1 part by weight of clay per 100 parts by weight of the sand, said binder consisting essentially of an aqueous solution of a water-soluble copolymer of a maleic acid-type monomer selected from the group consisting of maleic acid, maleic anhydride and maleic acid esters and a styrene comonomer and water glass and having a weight ratio of copolymer solids to water glass solids of 1:0.5 to 10.

2. A composition according to claim 1 wherein said binder is obtained by mixing an aqueous solution of the copolymer with water glass.

3. A composition according to claim 1 which further contains an additive selected from thickeners and dissolving assistants.

4. A composition according to claim 1 wherein the amount of the binder is about 2 to about 10 parts by weight per 100 parts by weight of the sand.

5. A composition according to claim 2 wherein the aqueous solution of the copolymer has a viscosity of about 500 to about 10,000 centipoises.

6. A composition according to claim 2 wherein said binder has a viscosity of about 5 to about 3,000 centipoises.

7. A composition according to claim 4 wherein the binder further contains about 1 to about 6 parts by weight, per 100 parts by weight of the sand, of a powder of a silicon material selected from the group consisting of silicon-containing alloys and silicon.

8. A composition according to claim 7 wherein the aqueous solution of the copolymer has a viscosity of about 500 to about 10,000 centipoises.

9. A composition according to claim 7 wherein the copolymer and water glass are in the pre-mixed state with the mixture having a viscosity of about 5 to about 3,000 centipoises.

10. A process for producing a foundry mold, which comprises mixing 100 parts by weight of a foundry mold sand containing less than 1 part by weight of clay with from about 2 to about 10 parts by weight of a binder consisting essentially of water glass and an aqueous solution of a water-soluble copolymer of a maleic acid type monomer selected from the group consisting of maleic acid, maleic anhydride and maleic acid esters and a styrene comonomer and having a viscosity of about 500 to about 10,000 centipoises, forming the mixture into a mold, and contacting the mold with carbon dioxide gas.

11. A process for producing a foundry mold, which comprises mixing 100 parts by weight of a foundry mold sand containing less than 1 part by weight of clay with about 2 to 10 parts by weight of a binder consisting essentially of water glass and an aqueous solution of a water-soluble copolymer of a maleic acid type monomer selected from the group consisting of maleic acid, maleic anhydride and maleic acid esters and a styrene comonomer and having a viscosity of about 500 to about 10,000 centipoises and about 1 to about 6 parts by weight of a powder of a silicon material selected from the group consisting of silicon-containing alloys and silicon, forming the mixture into a mold, and drying it under self-generated heat.

* * * * *